US007329221B2

(12) United States Patent
Haasl et al.

(10) Patent No.: US 7,329,221 B2
(45) Date of Patent: Feb. 12, 2008

(54) ASSEMBLY FOR AND METHOD OF GRIPPING SHEETS OF MATERIAL IN AN INTERFOLDER

(75) Inventors: Andrew L. Haasl, Green Bay, WI (US); Barton J. White, Freedom, WI (US)

(73) Assignee: FPNA Acquisition Corporation, Green Bay, WI (US)

( * ) Notice: Subject to any disclaimer, the term of this patent is extended or adjusted under 35 U.S.C. 154(b) by 0 days.

(21) Appl. No.: 10/953,379

(22) Filed: Sep. 29, 2004

(65) Prior Publication Data

US 2005/0070418 A1 Mar. 31, 2005

Related U.S. Application Data

(60) Provisional application No. 60/507,392, filed on Sep. 30, 2003.

(51) Int. Cl.
*B31F 1/10* (2006.01)

(52) U.S. Cl. ..... 493/428; 493/432; 493/431

(58) Field of Classification Search ..... 493/424, 493/428, 432, 431
See application file for complete search history.

(56) References Cited

U.S. PATENT DOCUMENTS

| | | | | |
|---|---|---|---|---|
| 1,895,124 | A | 1/1933 | Crafts et al. | |
| 2,872,186 | A * | 2/1959 | Raybuck | 493/418 |
| 3,765,671 | A * | 10/1973 | Blomberg | 493/476 |
| 3,820,774 | A * | 6/1974 | Hertrich | 493/471 |
| 3,924,849 | A * | 12/1975 | Murakami | 271/277 |
| 4,058,307 | A * | 11/1977 | Bubley et al. | 271/85 |
| 4,605,212 | A | 8/1986 | Kobler | |
| 5,056,773 | A * | 10/1991 | Weisgerber | 271/204 |
| 5,193,458 | A | 3/1993 | Keller | |
| 5,289,768 | A | 3/1994 | Keller | |
| 5,303,650 | A * | 4/1994 | Wieland | 101/409 |
| 5,468,209 | A | 11/1995 | Rohrhiursch et al. | |
| 5,477,780 | A | 12/1995 | Keller | |
| 5,622,113 | A | 4/1997 | Hansen | |
| 5,758,576 | A | 6/1998 | Mack et al. | |
| 6,048,297 | A | 4/2000 | Lange et al. | |
| 6,673,004 | B2 * | 1/2004 | Nanba et al. | 493/428 |
| 6,779,788 | B2 * | 8/2004 | Takahashi et al. | 270/20.1 |
| 6,896,648 | B2 * | 5/2005 | Fujinuma | 493/426 |
| 6,902,519 | B2 * | 6/2005 | Ochsner et al. | 493/428 |

FOREIGN PATENT DOCUMENTS

EP 1 361 187 11/2003

* cited by examiner

*Primary Examiner*—Sameh H. Tawfik
(74) *Attorney, Agent, or Firm*—Boyle Fredrickson, S.C.

(57) ABSTRACT

A folding machine includes a first folding roll with a series of the gripper assemblies and a series of tucker assemblies uniformly and alternately spaced to interact with a series of gripper and tucker assemblies of an adjacent second folding roll. The series of alternately spaced gripper and tucker assemblies interact to grip, carry, and release material in a manner so as to generate a folded stack of material, such as sheet material. Each of the gripper assemblies generally includes a rotatable blade, a shaft configured to rotate the blade, a spacer disposed between the blade and the shaft, and a bolt coupling the blade and the spacer to the shaft. A housing is configured with seals to retain lubricated bearings to provide rotation of the shaft of the gripper assembly and to prevent contamination of the bearings.

6 Claims, 5 Drawing Sheets

FIG. 5

ASSEMBLY FOR AND METHOD OF GRIPPING SHEETS OF MATERIAL IN AN INTERFOLDER

RELATED APPLICATIONS

This application claims the benefit under 35 U.S.C. § 119(e) of U.S. Provisional Application Ser. No. 60/507,392, filed Sep. 30, 2003, the entirety of which is hereby incorporated herein by reference.

FIELD OF THE INVENTION

This invention generally relates to an interfolding machine for interfolding sheets of material, and more specifically, to an interfolding machine that includes a folding roll having an assembly configured for gripping the sheets of material to create a fold in the sheets.

BACKGROUND OF THE INVENTION

Folding of sheets of material (e.g., paper, napkins, paper towels, tissue, etc.) is frequently performed using a pair of folding rolls that have interacting mechanical gripper and tucker assemblies. The gripper and tucker assemblies are uniformly spaced around a circumference of each respective folding roll to interact with one another so as to interfold the sheets of material. The tucker assemblies on one roll interact with the gripper assemblies of the adjacent roll, and vice versa, to alternately grip and tuck successive sheets of material fed between the rolls. As the rolls rotate, the gripper assemblies carry and release the folded sheets of material to create a zigzagged interfolded stack of sheets.

However, known gripper assemblies have several drawbacks. For example, known gripper assemblies utilize a shaft that is rotatably mounted to the roll using a series of spaced apart exposed bushing assemblies, all of which requires periodic lubrication. Furthermore, each folding roll includes a number of shafts, each of which is mounted using a number of such bushings, and each bushing constitutes a component that is subject to wear and potential failure and replacement. The folding roll operates in an environment in which the bushings are subject to introduction of contaminants, which can reduce shaft/bearing life and increase the torque required to rotate the shaft. Furthermore, the shaft of a gripper assembly of this type requires extensive low tolerance machining to assemble. Because of this machining requirement, it is not possible to use a hardened steel material for the gripper assembly shaft.

It is the object of the present invention to provide a gripper assembly for an interfolding machine that overcomes these shortcomings of the prior art.

SUMMARY OF THE INVENTION

In accordance with the present invention, a gripper assembly for a folding roll permits the use of a hardened steel shaft material by eliminating the machining required to form a prior art gripper assembly mounted with exposed bushings. The shaft is configured with a spacer arrangement that eliminates the need to machine the shaft. The gripper assembly further includes a series of lubricated bearings that are sealed in housings to preventing contaminants from entering the bearings.

In accordance with one embodiment of the present invention, a gripper assembly is mounted on a rotating folding roll for folding a sheet of material. The gripper assembly includes a blade, a shaft configured to rotate the blade, a spacer disposed between the blade and the shaft; and a bolt configured to couple the blade and the spacer to the shaft.

The bolt of the gripper assembly is threaded, and the shaft includes a threaded opening to receive the threaded bolt. The shaft includes a radially extending counterbore configured to receive at least a portion of the bolt. The counterbore in the shaft is in alignment with the opening in the blade and is sized to receive the bolt. The spacer includes an opening in alignment with the counterbore to receive the bolt. The spacer includes an arcuate-shaped surface that interfaces with the shaft. The shaft is comprised of a hardened-steel material, and is mounted in a series of interior and end mounted housing assemblies that include housings containing one or more lubricated needle bearings. The interior and end mounting housing assemblies further include seals to prevent debris from contaminating the bearings.

The invention also contemplates a folding machine that includes a first folding roll with a series of the gripper assemblies and a series of tucker assemblies uniformly and alternately spaced to interact with a series of gripper and tucker assemblies of an adjacent second folding roll. The series of alternately spaced gripper and tucker assemblies generally interact to grip, carry, and release sheets of material in a manner so as to generate a folded stack of sheets. Each of the gripper assemblies generally includes a rotatable blade, a shaft configured to rotate the blade, a spacer disposed between the blade and the shaft, and a bolt coupling the blade and the spacer to the shaft. A sealed housing includes greased bearings to lubricate the shaft.

In accordance with a further aspect of the present invention, there is provided a method of coupling a gripper assembly to a folding roll. The method includes the acts of providing a shaft disposed in a housing containing lubricated needle bearings and seals, the shaft having a threaded opening; aligning an opening of a spacer over the opening of the shaft; aligning an opening in a blade over the opening of the spacer and opening of the shaft; and coupling the blade and the spacer to the shaft with a fastener.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout. In the drawings.

DETAILED DESCRIPTION OF THE INVENTION

1. Interfolding Machine

Figure 1:
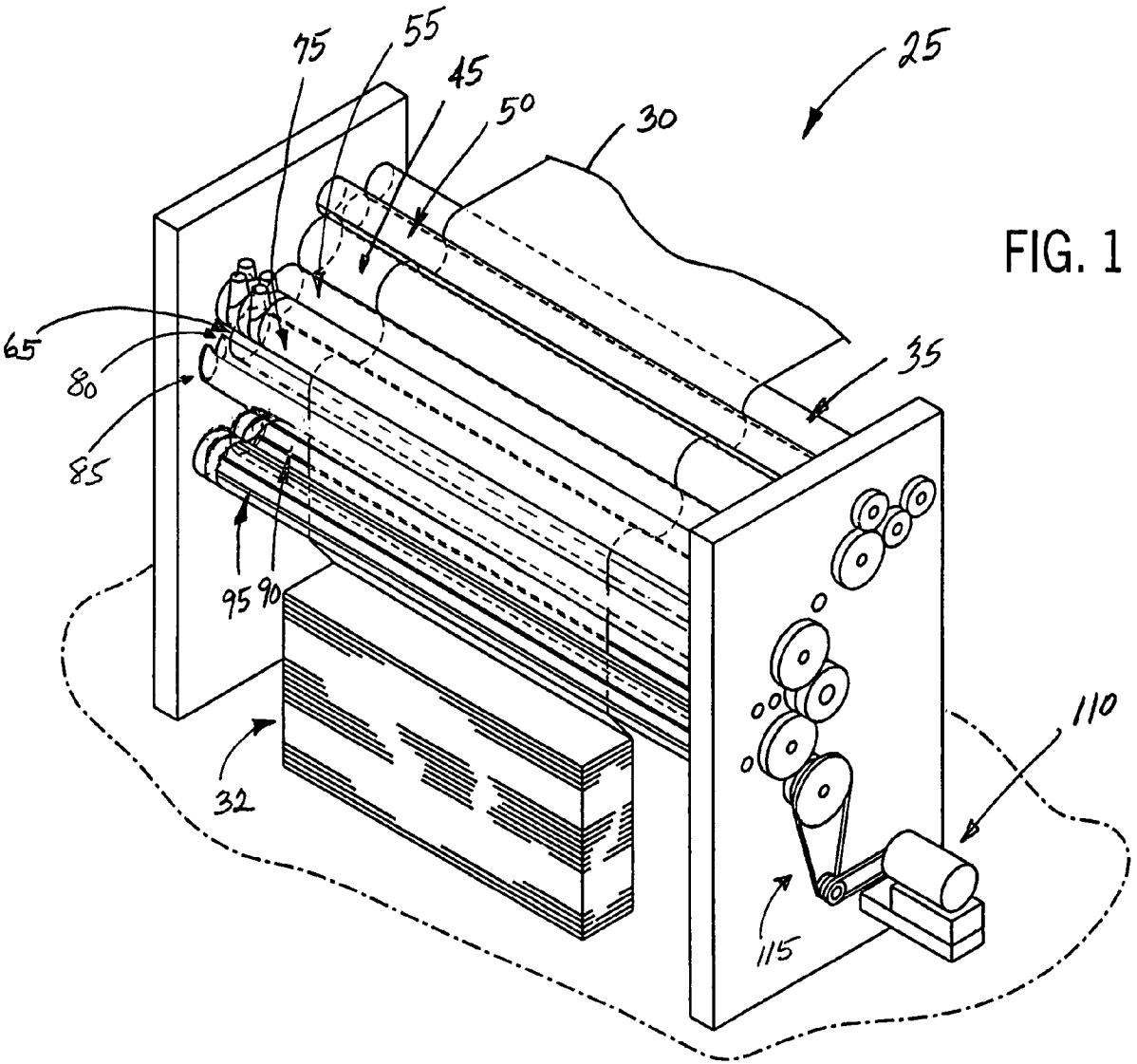
FIG. 1 is an isometric view of an interfolding machine employing a folding roll incorporating a gripper assembly in accordance with the present invention.
Figure 2:
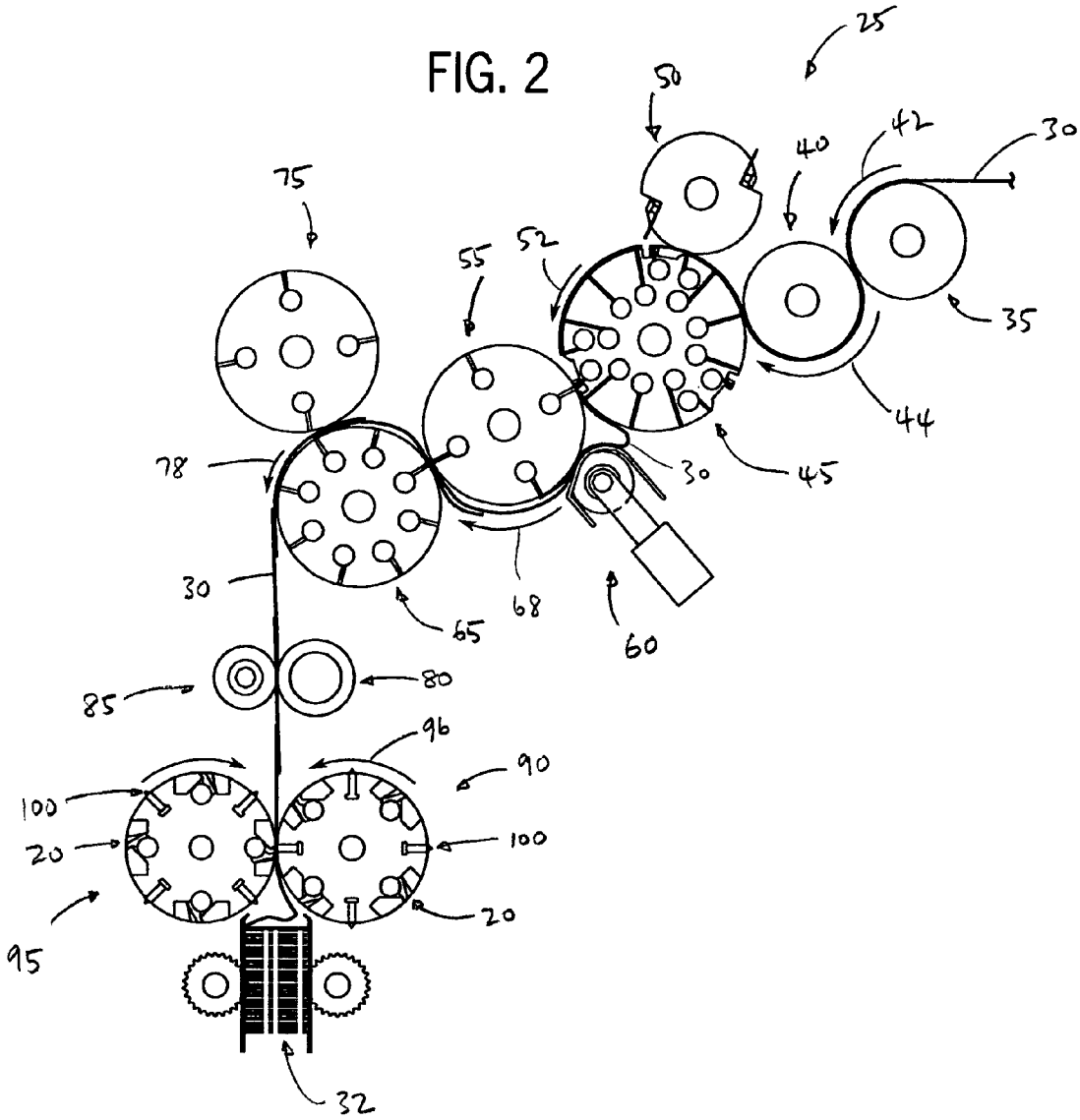
FIG. 2 is a schematic side elevation view of the interfolding machine as shown in FIG. 1.

Referring to FIGS. 1 and 2, an interfolding machine 25 is operable to convert a web of material 30 into a stack of interfolded sheets of material shown at 32. Interfolding machine 25 incorporates folding rolls incorporating the gripper assembly of the present invention, and generally includes a first pull roll 35 and a second pull roll 40 that receive the web of material 30 along a path (illustrated by an arrow 42 in FIG. 2) from a supply roll (not shown) into the interfolding machine 20. The first and second pull rolls 35 and 40 define a nip through which the web of material 30 passes, and function to unwind the web of material 30 and feed the web of material 30 in a path (illustrated by an arrow 44 in FIG. 2) toward a nip defined between second pull roll 40 and a bed roll 45. The web of material 30 is then advanced by bed roll 45 toward a knife roll 50. In a manner as is known, the knife roll 50 cuts the web of material 30 into sheets, each of which has a predetermined length, and the bed roll 45 carries the sheets of material along a path (illustrated by arrow 52 in FIG. 2) toward and through a nip defined between bed roll 45 and a retard roll 55, which rotates at a slower speed of rotation than the bed roll 45. In a manner as explained in copending application Ser. No. 10/953,175 the retard roll 55 cooperates with a nip roller assembly 60 (FIG. 2) to form an overlap between the consecutive sheets of material. The retard roll 55 carries the overlapped sheets of material along a path (illustrated by arrow 68 in FIG. 2) to a lap roll 65.

The lap roll 65 works in combination with a count roll 75 to eliminate the overlap between adjacent sheets of material at a predetermined sheet count, so as to create a separation in the stack 32 of interfolded sheets discharged from the interfolding machine 25. The lap roll 65 carries the overlapped sheets of sheet 30 along a path (illustrated by arrow 78 in FIG. 2) toward a nip defined between a first assist roll 80 and an adjacent second assist roll 85. The first and second assist rolls 80 and 85 feed the sheets of the material to a nip defined between a first folding roll 90 and a second folding roll 95.

Referring to FIG. 2, the first and second folding rolls 90 and 95 generally rotate in opposite directions (illustrated by arrows 96 and 98, respectively, in FIG. 2) to receive the overlapped sheets of material 30 therebetween. The periphery of the first folding roll 90 generally includes a series of the gripper assemblies 20 in accordance with the invention, and a series of tucker assemblies 100 uniformly and alternately spaced to interact with a series of gripper assemblies 20 and tucker assemblies 100 of the adjacent second folding roll 95. The series of alternately spaced gripper assemblies 20 and tucker assemblies 100 of the first and second folding rolls 90 and 95 interact to grip, carry, and release the sheets of material in a desired manner so as to form the desired interfolded relationship in the sheets of material and to form stack 32 of interfolded sheets. The folding rolls 90 and 95 may be driven by a drive system 110 having a drive belt assembly 115 (FIG. 1).

The stack 32 of interfolded sheets is discharged from between the first and second folding rolls 90 and 95 in a generally vertically-aligned fashion. The stack 32 of interfolded sheets may be supplied to a discharge and transfer system (not shown), which guides and conveys the stack 32 from the generally vertically-aligned orientation at the discharge of the interfolding machine 25 to a generally horizontally-aligned movement. One embodiment of a suitable discharge and transfer system is described in U.S. Pat. No. 6,712,746 entitled "Discharge and Transfer System for Interfolded Sheets," filed May 5, 2000, the disclosure of which is hereby incorporated herein by reference in its entirety. Another representative discharge and transfer system is illustrated in copending application Ser. No. 10/610,458, the disclosure of which is also hereby incorporated herein by reference in its entirety.

2. Gripper Assembly

As illustrated in FIG. 2, each of the gripper assemblies 20 is generally located at a distance from the next adjacent tucker assembly 100 along a circumference of each of the first and second folding rolls 90 and 95. The spacing between the gripper assemblies 20 and the tucker assemblies 100 determines the longitudinal dimension or length between the folds in the sheets of sheet 30 as measured in a direction of travel (illustrated by arrows 96 and 98) of the first and second folding rolls 90 and 95.

Figure 3:
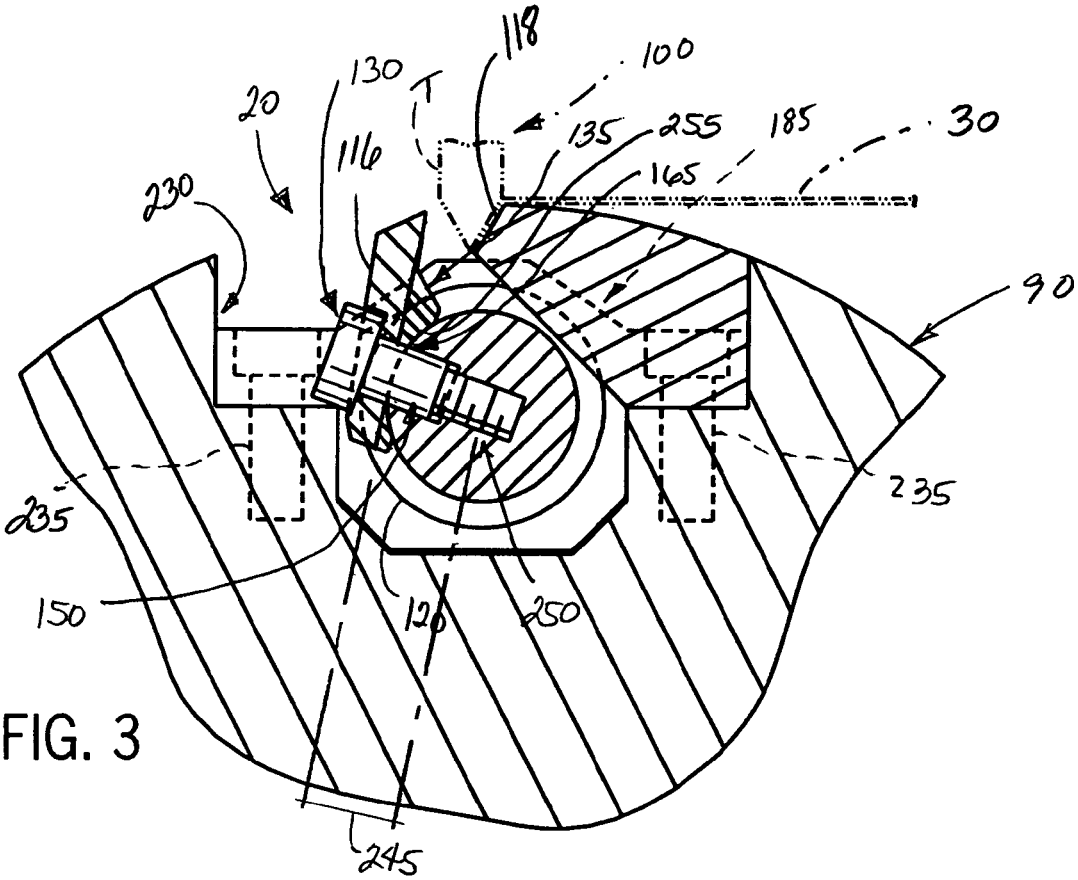
FIG. 3 is a detailed cross-sectional view of a gripper assembly mounted on a folding roll as shown in FIG. 1, showing the gripper assembly in an open position.
Figure 4:
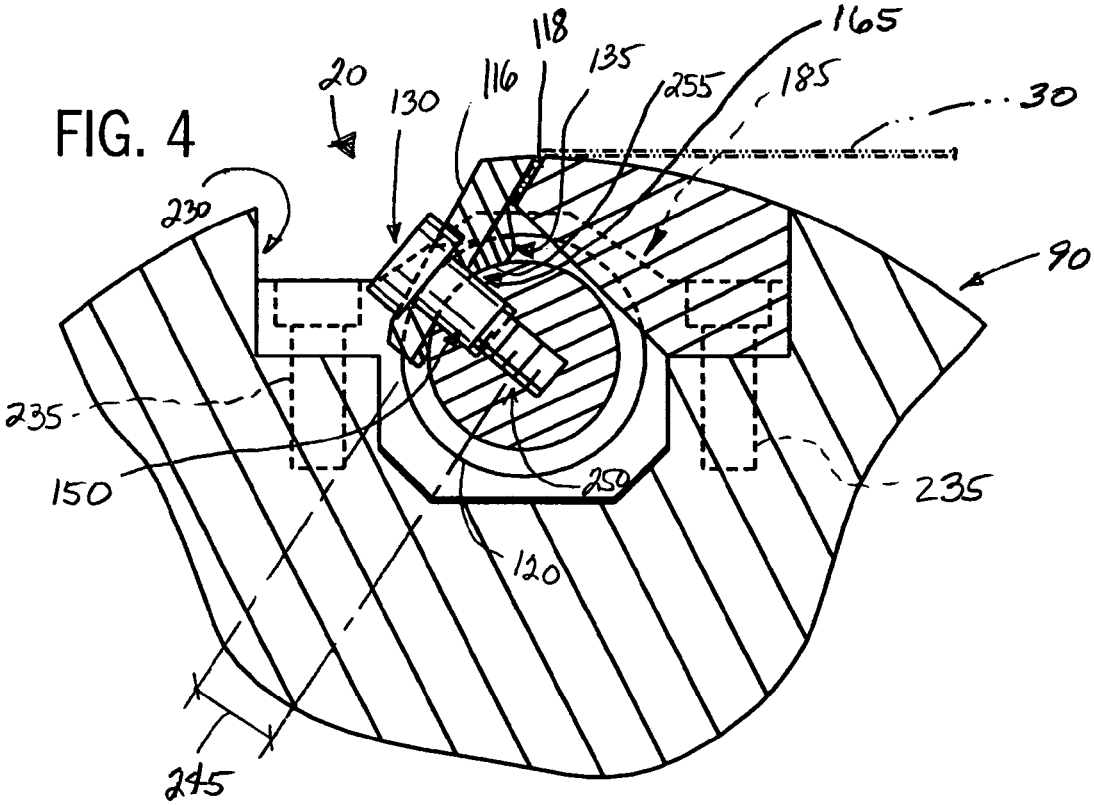
FIG. 4 is a detailed cross-sectional view similar to FIG. 2, showing the gripper assembly in a closed position.

FIGS. 3 and 4 illustrate a detailed cross-sectional view of one of the series of gripper assemblies 20 of the folding roll 90, which interacts with one of the series of tucker assemblies 100 of the adjacent folding roll 95 (See FIG. 2). It is understood that the other alternating series of gripper assemblies 20 and tucker assemblies 100 of both the first and second folding rolls 90 and 95 (as schematically illustrated in FIG. 2) are constructed similarly and interact in a similar manner.

Each gripper assembly 20 is generally recessed with respect to the outer circumference of the adjacent folding roll, such as 95 (See FIG. 2). As illustrated in FIG. 3, the tucker assembly 100 generally includes a tucker member that extends in a radial outward direction from the outer circumference of the folding roll 95 to engage the gripper assembly 20 of the first folding roll 90. Representatively, tucker assembly 100 may be constructed as shown and described in copending application Ser. No. 10/953,176, the disclosure of which is hereby incorporated by reference. As the sheet 30 moves between the first and second folding rolls 90 and 95, the tucker member T of tucker assembly 100 is configured to tuck the sheet 30 between a blade 116 and an anvil 118 of the gripper assembly 20, when the gripper assembly 20 is in an open position. As illustrated in FIG. 4, the blade 116 of the gripper assembly 20 subsequently rotates in a timed manner to grip the tucked sheet 30 against anvil 118 as the tucker member T of tucker assembly 100 is moved out of engagement with the sheet 30. In the closed position, the gripper assembly 20 carries and then releases the sheet 30 so as to create the folds in the sheets 30 that are formed in stack 32.

Figure 5:
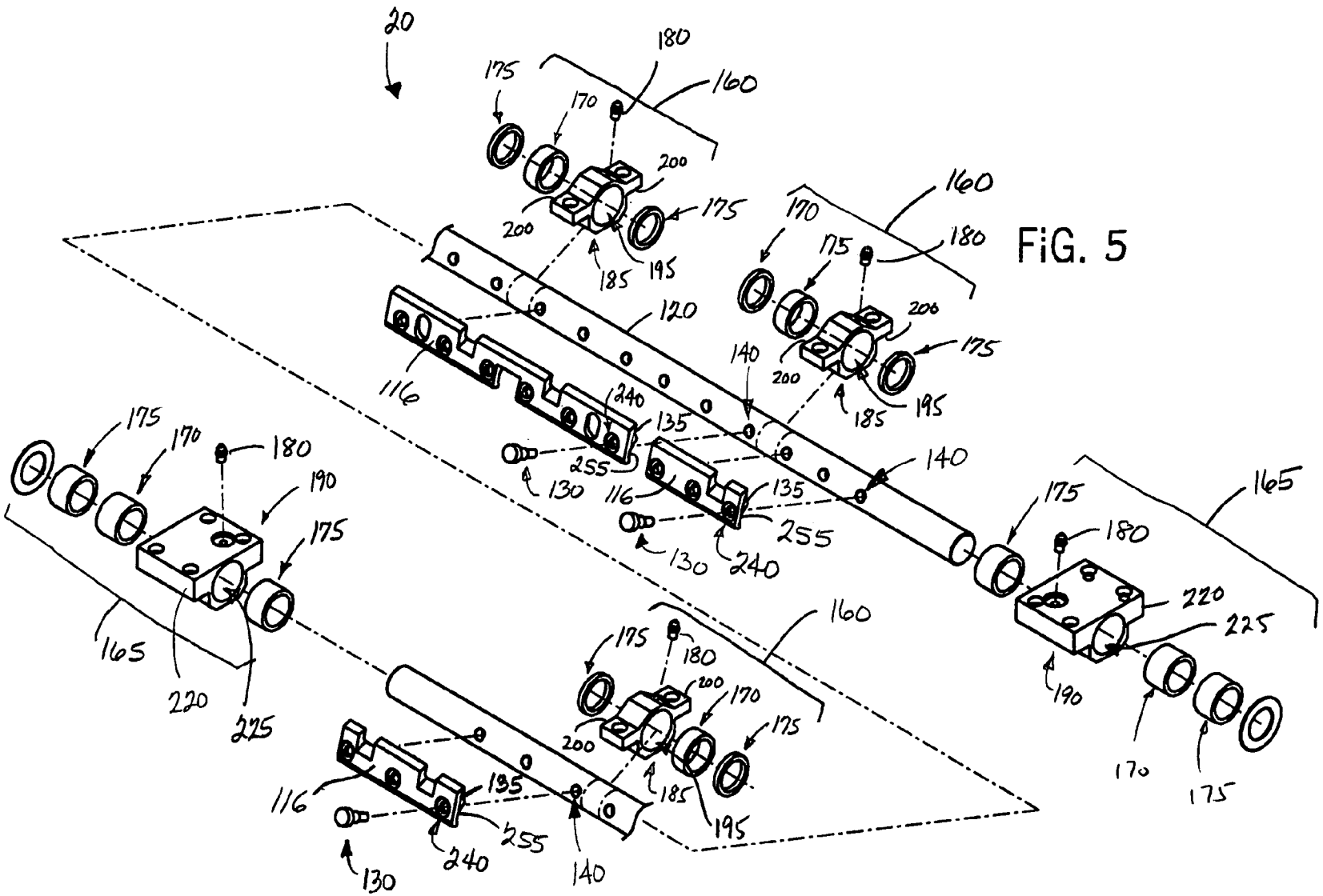
FIG. 5 is an exploded isometric view of the gripper assembly in accordance with the present invention as shown in FIGS. 2 and 3.

FIG. 5 shows an exploded view of an exemplary embodiment of gripper assembly 20. In addition to the blade 116 and the anvil 118 illustrated in FIGS. 3 and 4, the gripper assembly 20 generally includes a shaft 120, a series of shoulder bolts 130, and a spacer 135. Blade 116 is provided in a series of blade sections, each of which includes a spacer 135.

Still referring to FIG. 5, the shaft 120 includes a series of threaded openings that are adapted to receive the series of shoulder bolts 130. In a preferred embodiment, each opening is in the form of a counterbore 140 having a threaded inner passage that receives the threaded end of one of shoulder bolts 130. The shaft 120 is machined within a close tolerance to such that the outer portion of each counterbore 140 receives at least a portion of a body 150 (See FIGS. 3 and 4) of one of shoulder bolts 130. The size of the shoulder bolts 130 and counterbores 140 can vary.

Shaft 120 is mounted in a series of interior housing assemblies 160 and a pair of end housing assemblies 165 that generally includes a series of bearings 170 and seals 175 to retain a lubricant (e.g., grease) for lubricating the gripper assembly 20. The shaft 120 is preferably comprised of a hardened-steel material although it is understood that any other satisfactory hardened metallic or non-metallic material may be employed. In a preferred form, bearings 170 are needle-type bearings and are also generally comprised of hardened steel material. Each of the sealed housing assemblies 160 and 165 includes a fill plug 180 to receive the lubricant for the bearings 170. The use of the hardened-steel shaft 120 in conjunction with the hardened-steel needle bearings 170 permits use of the sealed housing assemblies 160 and 165 for lubricating the gripper assembly 20, which significantly increases the wear resistance of shaft 120 and bearings 170 and also reduces maintenance requirements. The provision of seals 175 for housing assemblies 160 and 165 generally inhibits debris from contaminating the needle bearings 170. The housing assemblies 160 and 165 also simplify construction and assembly, increase the life of the bearings 170 and the shaft 120, and reduce the torque required to rotate the shaft 120. Shaft 120 is nonetheless operable to accurately locate the blade 116 of the gripper assembly 20 and to move the blade 116 between the open and closed positions.

Figure 6:
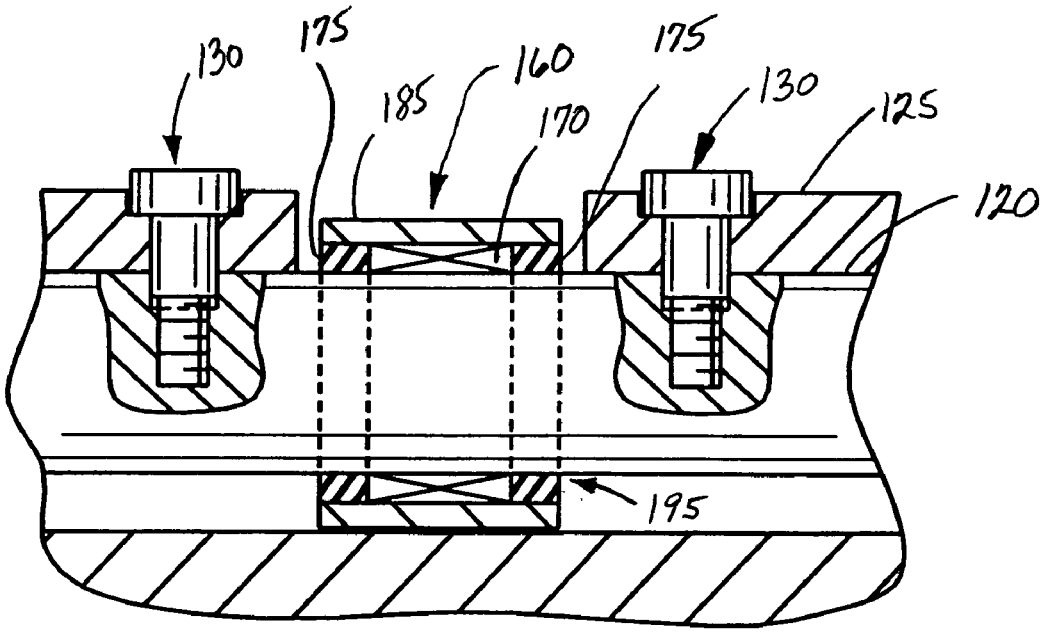
FIG. 6 is a detailed cross-sectional view of a housing assembly incorporated in the gripper assembly of FIGS. 2-4 for receiving the shaft of the gripper assembly.

Still referring to FIG. 5, the greased sealed housing assemblies 160 and 165 include housings 185 and 190, respectively, to receive the bearings 170. The housing 185 of the interior housing assemblies 160 generally includes a passage 195 to receive the shaft 120, and a pair of mounting plates 200. FIG. 6 shows a detailed cross-sectional view of the interior housing assembly 160 in rotational support of the shaft 120. The housing 185 in combination with the seals 175 generally seals the lubricant for the bearing 170. Referring again to FIG. 5, the housing 190 of the end housing assemblies 165 generally includes a mounting block 220 with a passage 225 to receive the shaft 120. Referring to FIGS. 3 and 4, the housings 185 and 190 of the interior and end mounted housing assemblies 160 and 165, respectively, are generally shaped to conform to a recessed portion 230 of the folding roll 90 within which the shaft 120 of the gripper assembly 20 is received. The housing assemblies 160 and 165 are secured by fasteners 235 to the folding roll 90, although it is understood that the housing assemblies 160 and 165 may be mounted to the folding roll 90 in any other satisfactory manner. The number of housing assemblies 160 and 165 can vary.

Referring again to FIG. 5, the sections of blade 116 are machined to include a series of openings 240 in general alignment with the counterbore 140 of the shaft 120 so as to receive the shoulder bolt 130. In assembly, the blade sections 116 are final machined after the gripper assembly 20 is assembled on the folding roll 90. This aspect also simplifies construction of the folding machine 25.

Referring now to FIGS. 3-5, the spacer 135 is disposed between each section of blade 116 and the shaft 120. As illustrated in FIGS. 3-4, the spacer 135 includes a flat outer surface with which blade 116 is engaged, and an opening 165 in general alignment with the counterbore 140 and the opening 240 in the blade 116 to receive the shoulder bolt 130. The spacer 135 is machined to within a close tolerance of a height 245 from a center 250 of the shaft 120. The spacer 135 further includes an arcuate-shaped inner surface 255 to interface with a circumference of the shaft 120. The spacer 135 can be a separate component, or may be integrally formed with the blade 116 for attachment to the shaft 120 of the folding roll 90.

With the construction of gripper assembly 20 as shown and described, shaft 120 is formed of a hardened steel material that simply requires the formation of counterbores 140 for assembly into gripper assembly 20. This eliminates the need to machine the gripper shaft as in the prior art to mount bearings. In addition, shaft 120 is rotatably supported by sealed grease-type bearings, which reduce maintenance and accommodate the unmachined shaft 120. The surface of shaft 120 thus essentially functions as the inner race of the needle bearings that rotatably support the shaft 120. Further, the use of spacers 135 to mount blade 116 also eliminates the need to machine the gripper shaft as in the prior art to provide a surface to which the gripper blade can be mounted. All of these features combine to provide a high performance gripper assembly that is relatively easy to manufacture and assemble, and which provides relatively low maintenance during operation.

A wide variety of machines or systems could be constructed in accordance with the invention defined by the claims. Hence, although the exemplary embodiment of a gripper assembly 20 in accordance with the invention has been generally described with reference to an interfolding machine 25 for folding a web sheet 30 into a zig-zagged stack 32, the application of the gripper assembly 20 is not so limited. The gripper assembly 20 of the invention could be employed to grip, carry, and release any type of sheet or web being fed to a wide variety of uses to machines and is not limiting on the invention.

The above discussion, examples, and embodiments illustrate our current understanding of the invention. However, since many variations of the invention can be made without departing from the spirit and scope of the invention, the invention resides wholly in the claims hereafter appended.

We claim:

1. A folding machine for folding material, comprising:

a first rotating folding roll; and a second rotating folding roll positioned adjacent to the first rotating folding roll, wherein the first and second folding rolls each include a plurality of alternating tucker assemblies and gripper assemblies, wherein one of the plurality of gripper assemblies of one of the first and second folding rolls is positioned to interact with one of the plurality of tucker assemblies of the other folding roll for folding the material therebetween, and wherein at least one of the plurality of gripper assemblies comprises:

a blade;

a shaft configured to rotate the blade, wherein the shaft defines a pair of ends, and wherein each end of the shaft has a circular cross section;

a pair of spaced apart bearings carried by the roll and located one at each end of the shaft, wherein each bearing includes a series of bearing members that rotatably support the shaft on the roll, wherein the bearing members engage an outer surface defined by the circular cross section of the shaft at the ends of the shaft;

one or more mounting members interposed between the blade and the shaft;

wherein the shaft defines a circular cross section at the location of each mounting member, and wherein each mounting member includes an arcuate inner surface that engages a facing arcuate outer area of the shaft defined by the circular cross section of the shaft, wherein the shaft includes one or more transverse passages, each of which extends inwardly into the shaft from the arcuate outer area of the shaft at the location of each mounting member; and a plurality of fasteners configured to couple the blade to the shaft, wherein each fastener extends through the blade and the mounting member into one of the transverse passages to secure the blade and the mounting member to the shaft.

2. The folding machine as recited in claim 1, wherein each transverse passage comprises a threaded counterbore configured to receive one of the fasteners.

3. The folding machine as recited in claim 1, wherein each end of the shaft is mounted in a housing assembly and wherein the series of bearing members comprise one or more needle bearings.

4. The folding machine as recited in claim 1, wherein the shaft and the bearing members are comprised of a hardened-steel material, and wherein the housing assembly includes seals to prevent contaminants from reaching the bearing members.

5. The folding machine as recited in claim 1, wherein each mounting member comprises a spacer between the shaft and a flat surface defined by the blade, wherein the spacer includes an opening in alignment with one of the transverse passages in the shaft to receive one of the fasteners.

6. The folding machine as recited in claim 5, wherein each spacer includes a flat outer engagement area that engages the flat surface of the blade.

* * * * *